US007441284B2

(12) United States Patent
Pansini

(10) Patent No.: US 7,441,284 B2
(45) Date of Patent: Oct. 28, 2008

(54) HOSE REEL AUTOMATIC STORAGE

(76) Inventor: Andrew L. Pansini, 200 Golden Gate Ave., Belvedere, CA (US) 94920

( * ) Notice: Subject to any disclaimer, the term of this patent is extended or adjusted under 35 U.S.C. 154(b) by 476 days.

(21) Appl. No.: 11/167,632

(22) Filed: Jun. 27, 2005

(65) Prior Publication Data

US 2005/0236508 A1 Oct. 27, 2005

Related U.S. Application Data

(63) Continuation-in-part of application No. 10/078,802, filed on Feb. 19, 2002, now Pat. No. 6,974,103.

(51) Int. Cl.
*E04H 4/00* (2006.01)

(52) U.S. Cl. ..... 4/490; 137/355.16

(58) Field of Classification Search ..... 4/490, 4/492; 137/355.16, 355.18, 355.19, 355.2, 137/355.21, 355.22; 242/390, 390.2, 390.5; 134/167 R, 138 R See application file for complete search history.

(56) References Cited

U.S. PATENT DOCUMENTS

| | | | | |
|---|---|---|---|---|
| 307,784 | A | 11/1884 | Little | |
| 1,537,637 | A * | 5/1925 | Jarvis | 137/355.12 |
| 2,595,655 | A | 5/1952 | Hannay | 242/86 |
| 3,139,099 | A | 6/1964 | Anthony | 134/167 |
| 3,217,738 | A | 11/1965 | Springsteed | 137/355.2 |
| 3,278,949 | A | 10/1966 | Whitaker | 4/172 |
| 3,289,216 | A | 12/1966 | Anthony | 4/172 |
| 3,392,738 | A | 7/1968 | Pansini | 134/167 |
| 3,471,885 | A | 10/1969 | McLoughlin et al. | 15/40 |
| 3,676,884 | A | 7/1972 | Wule | |
| 4,228,553 | A | 10/1980 | Genuit | 4/490 |
| 4,281,995 | A | 8/1981 | Pansini | 440/38 |
| 4,348,192 | A | 9/1982 | Pansini | 440/38 |
| 4,768,532 | A | 9/1988 | Johnson | 134/111 |
| 4,770,711 | A | 9/1988 | Deal, III et al. | 134/18 |
| 6,895,984 | B1 | 5/2005 | Pansini | 137/355.16 |

FOREIGN PATENT DOCUMENTS

| | | | |
|---|---|---|---|
| JP | 11314841 | A | 11/1999 |

* cited by examiner

*Primary Examiner*—Huyen Le
(74) *Attorney, Agent, or Firm*—John K. Uilkema; Thelen LLP

(57) ABSTRACT

A device for moving the hose of an automatic pool cleaner in and out of a swimming pool using water power. The device includes a rotatable hose reel disposed within a tank spaced from the pool. In one embodiment, the tank communicates with the pool through an under-the-deck tunnel. In another, the tunnel extends from the tank and over the deck of the pool, for discharge into the pool. The hose reel is connected to a rotatable water wheel having vertically-oriented blades disposed around its circumference. To move the hose from the storage position into the pool, a stream of water from a blow out jet nozzle flushes the hose into the pool and rotates the hose reel in a first direction, causing the hose to unwind and travel into the pool. To move the hose from the pool back into the storage position, pressurized water is directed horizontally at the vertically-oriented blades of the water wheel, causing the water wheel and hose reel to rotate in a second direction to withdraw the hose from the pool and rewind the hose onto the hose reel.

12 Claims, 10 Drawing Sheets

HOSE REEL AUTOMATIC STORAGE

RELATED APPLICATION

This is a continuation-in-part of U.S. application Ser. No. 10/078,802, filed Feb. 19, 2002, by Andrew L. Pansini, the inventor herein.

BACKGROUND OF THE INVENTION

1. Field of the Invention

The present invention relates to an automatic storage device for use in connection with a swimming pool cleaner. More specifically, the invention relates to an automatic storage device for moving the hose of an automatic pool cleaner in and out of a swimming pool using water power. The device can be used with both conventional suction pool cleaners and conventional pressure pool cleaners. The device of the invention accommodates both under-the-deck installations, as might be incorporated into new pools during the course their construction, or over-the-deck installations which might be added to pre-existing pools, without disturbing the construction of the pools or their surrounding deck structure.

2. Related Art

Both suction and pressure-type pool cleaners are well known in the art. U.S. Pat. No. 3,392,738, discloses a swimming pool cleaner including a length of hose attached at one end to a terminal cleaning nozzle and jet nozzle transport means for moving the hose along the bottom surface of a pool.

One problem associated with any type of pool cleaner is removal of the hose from the pool and storage of the hose when the cleaner is not in use. U.S. Pat. No. 3,392,738, discloses storage means including a cylindrical compartment containing a rotatable winding reel. The winding reel includes a drum portion attached to a base portion. Directing water through a first nozzle rotates the reel in a counterclockwise direction to wind up the hose and directing water through a second nozzle rotates the reel in a clockwise direction to reel out the hose. The device of U.S. Pat. No. 3,392,738, would not effectively return to the pool, because it does not disclose a means for turning off the cleaner while the rotation jets are in operation. The cleaner would act to unwind the reel in opposition to the rotation jet. Also, the device cannot accommodate the head of a standard cleaner. A standard cleaner head includes an impeller; as water passes through the head, the impeller rotates, which turns a set of wheels that are in contact with the pool floor or walls. This allows the cleaner head to move about the pool. If such a cleaner head were pulled into the device, it would be lying on its side, with no wall or floor contact for the wheels, and would not be able to aid in unwinding the hose reel. Finally, the device does not lend itself for automation. A solenoid valve could not be placed on the revolving line to the rotation jet. Therefore, there is a need to provide a device for moving the hose of a pool cleaner in and out of a swimming pool, and particularly for returning the hose to the pool.

SUMMARY OF THE INVENTION

The present invention is directed to a device for moving the hose of an automatic pool cleaner in and out of a swimming pool. The device includes a tank in communication with the pool through a passageway and a rotatable hose reel having a drum portion and a circular base portion; or a tank and hose reel which has a tunnel extending over the deck of the pool, for discharge into the pool. Water jets connected to a pressurized water source direct water at the hose to rotate the hose reel in a first direction and flush the hose into the pool. The device further includes a circular, rotatable water wheel connected to the hose reel. The water wheel has a plurality of vertically-oriented blades disposed around its circumference. Directing water horizontally at the blades of the water wheel causes the water wheel and hose reel to rotate in a second direction to remove the hose from the pool and rewind it around the hose reel.

According to an alternative embodiment, the water wheel is replaced with a set of rotation jets that rotate the hose reel. A donut-shaped, hollow swivel is utilized having a rotatable upper portion connected to the hose reel and a fixed lower portion connected to a pressurized water source. Supplying water to the interior chamber of the swivel causes the rotatable upper portion and the hose reel to rotate in a second direction to remove the hose from the pool and rewind it around the hose reel.

Other objects, features and advantages of the present invention will be apparent to those skilled in the art upon a reading of this specification including the accompanying drawings.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figure 1:
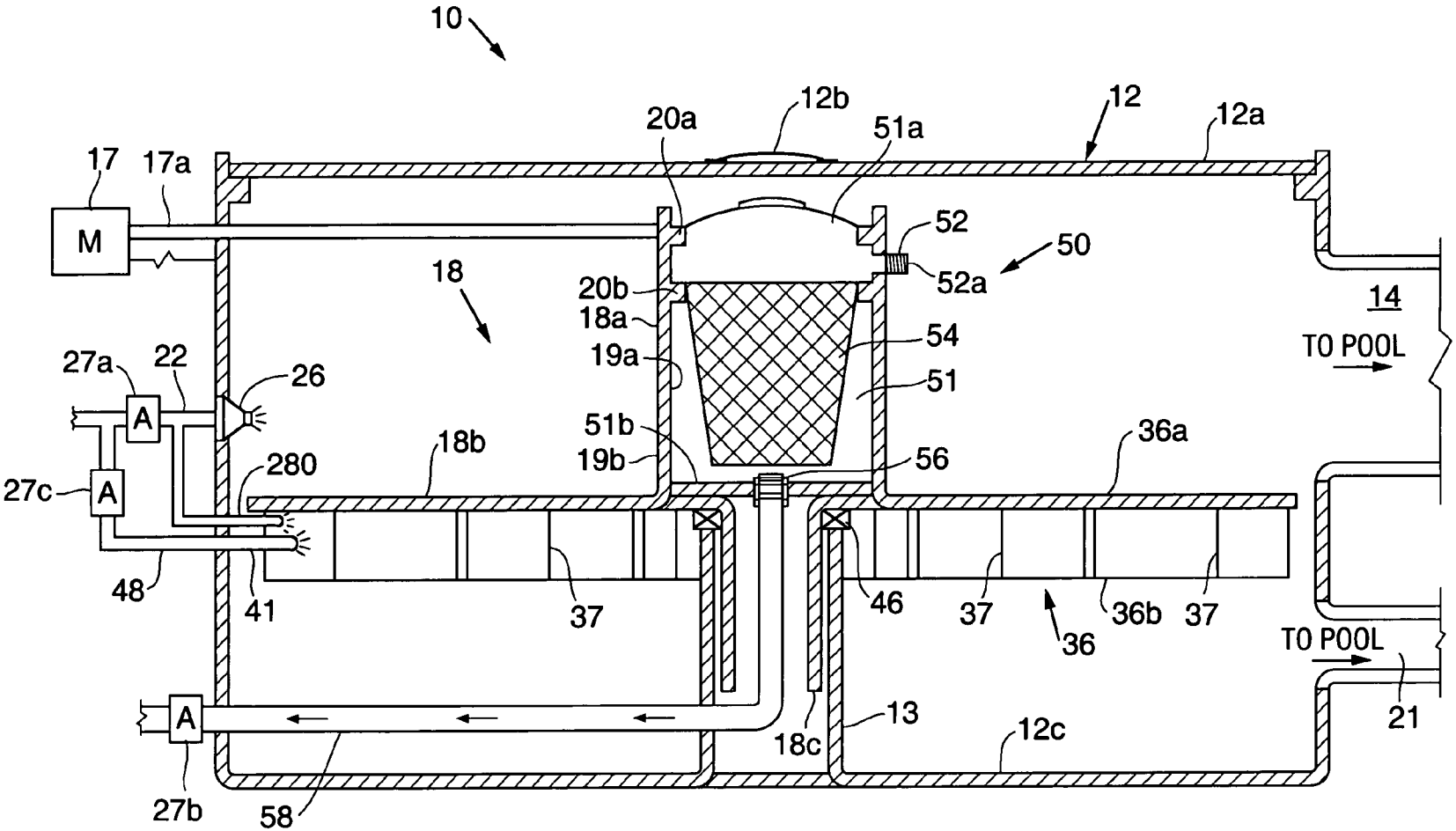
FIG. 1 is a cross-sectional elevational view of a first embodiment of the invention used in connection with a suction pool cleaner, showing the hose reel in cross-section, with the hose removed.

In describing preferred embodiments of the present invention illustrated in the drawings, specific terminology is employed for the sake of clarity. However, the invention is not intended to be limited to the specific terminology so selected, and it is to be understood that each specific element includes all technical equivalents that operate in a similar manner to accomplish a similar purpose.

The Under-The-Deck Embodiments

The first and second embodiments of the hose reel automatic storage device, designated 10, 100, respectively, are intended for under-the-deck installation and can be used in connection with either a conventional suction pool cleaner 50 or a conventional pressure pool cleaner 60.

Figure 2:
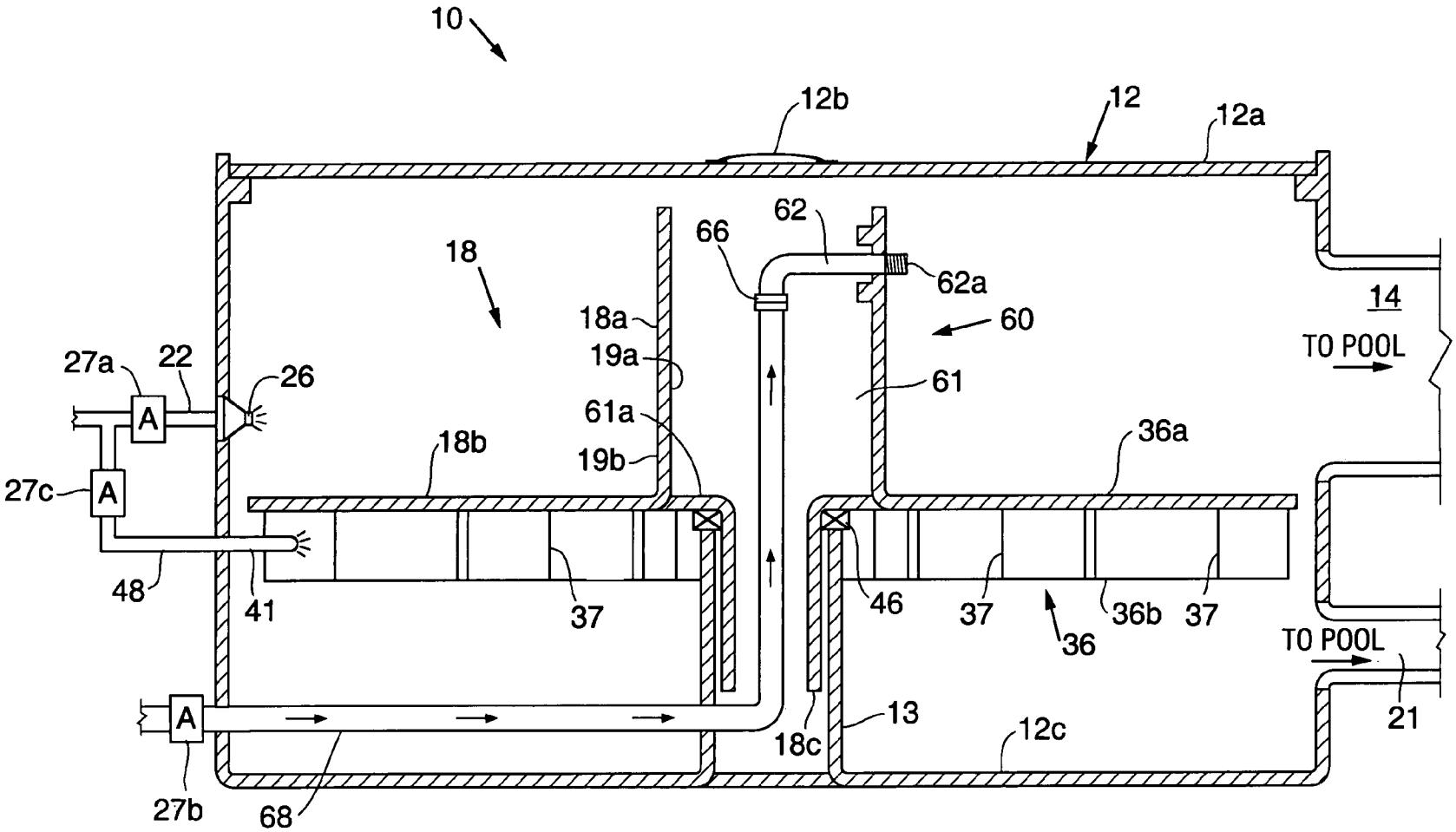
FIG. 2 is a cross-sectional elevational view of the first embodiment of the invention used in connection with a pressure pool cleaner, showing the hose reel in cross-section, with the hose removed.
Figure 3:
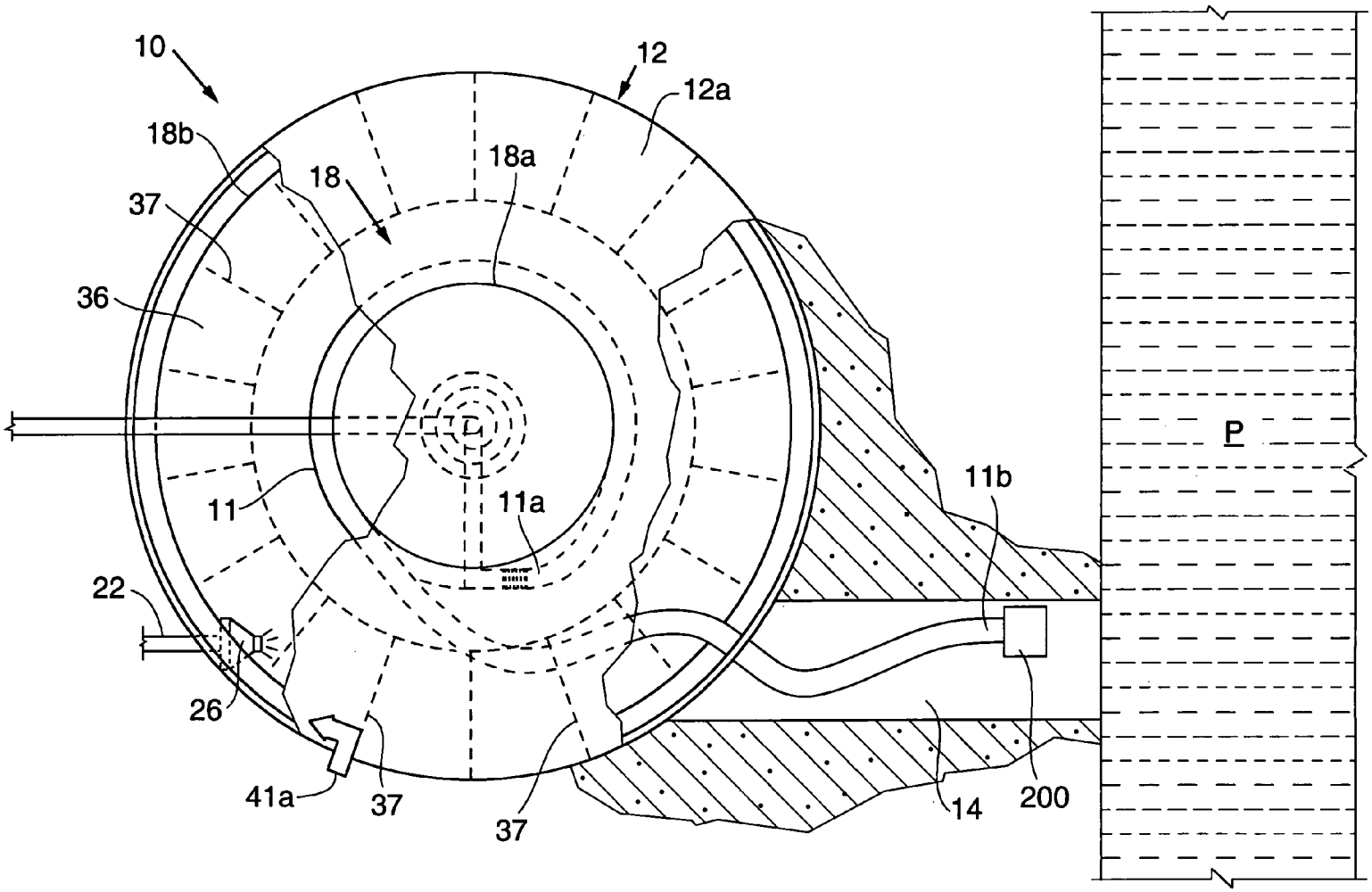
FIG. 3 is a top plan view of the first embodiment of the invention.

With reference to FIGS. 1-3, according to the first embodiment of the invention, device 10 includes a tank 12 having a removable cover plate 12*a*, with a handle 12*b*; a hollow, rotatable hose reel 18 having an upper circular drum portion 18*a*, a circular base portion 18*b*, adapted to support hose 11 when it is wound around drum portion 18*a*, and a lower cylindrical portion 18*c*, extending vertically downwardly from base portion 18*b*; and a circular, rotatable water wheel 36 connected to the base portion 18*b*, and having a central hole formed therethrough. Tank 12 further includes a drain passageway 21 connecting the lower portion of tank 12, where water wheel 36 is located, to pool P and a support cylinder 13 concentric with the circular base portion 18*b*. A bearing 46 supports circular base portion 18*b*, on the cylinder 13.

Tank 12 contains either suction cleaner 50 (FIG. 1) or pressure cleaner 60 (FIG. 2). Tank 12 is connected to swimming pool P through a horizontally extending passageway 14. Passageway 14 is configured to receive the hose 11 of suction pool cleaner 50 or pressure cleaner 60. Hose 11 is typically about 30, to 50, feet long and has a cleaner head 200 attached at one end. The cleaner head 200 of hose 11 may rest in passageway 14 during storage, when hose 11 is wound around hose reel 18. The cleaner head 200 can be any conventional cleaner head, such as that disclosed in U.S. Pat. No. 3,392,738, or the RAY-VAC® Automated Pool Vacuum sold by Waterpik Technologies—Jandy Products.

As illustrated in FIG. 1, suction pool cleaner 50 includes a leaf basket 54 contained in a sealed chamber 51 defined by the inner wall 19*a*, of drum portion 18*a*, of hose reel 18, cover plate 51*a*, and floor 51*b* of chamber 51. Cover plate 51*a*, is positioned over leaf basket 54 and held in place to seal off chamber 51 by circular shoulder 20*a*. Circular shoulder 20*b*, engages the outer edge of basket 54. Hose connection 52 communicates with suction chamber 51 of suction pool cleaner 50 and terminates in cleaner fitting 52*a*, which is adapted to engage first end 11*a*, of hose 11 (see FIG. 3). Pipe 58 is connected to a suction source (not shown) and extends vertically upwardly through lower cylindrical portion 18*c*, of hose reel 18, the central hole in water wheel 36, floor 51*b* of chamber 51 and into chamber 51 via swivel 56. Pipe 58 and hose connection 52 preferably have diameters of about 1¼ to about 1½ inches.

As illustrated in FIG. 2, pressure pool cleaner 60 includes an open chamber 61 defined by the inner wall 19*a*, of drum portion 18*a*, of hose reel 18, and floor ledge 61*a*, of chamber 61, which is formed integrally as a part of cylindrical portion 18*c*, of hose reel 18. Pipe 68 is connected to a pressurized water source (not shown) and extends vertically upwardly through lower cylindrical portion 18*c*, of hose reel 18, the central hole in water wheel 36, and into chamber 61, terminating at swivel 66. Elbow-shaped hose connection pipe 62 penetrates through an opening in hose reel 18, connects to pipe 68 via swivel 66 and is rotatable around the axis of swivel 66. Pipe 68 and hose connection pipe 62 preferably have diameters of about ¾ to about 1 inch. Hose connection pipe 62 terminates in cleaner fitting 62*a*, which is adapted to engage first end 11*a*, of hose 11. Pressure pool cleaner 60 employs water pressure rather than suction. Therefore, it does not include a cover plate 51*a*, or floor 51*b*, as provided in suction pool cleaner 50, and hose reel 18 does not include circular shoulders 20*a*, 20*b*.

Tank 12 may be circular; preferably having a diameter of about 36, inches and a depth of about 12-to-16, inches. It is preferably constructed of stainless steel or plastic, but can be constructed of any other suitable material. Cover plate 12*a*, is provided with a handle 12*b* or any other suitable means, such as a central aperture, relative to the tank 12 to facilitate removal and replacement of cover plate 12*a*, relative to the tank 12.

Rotatable hose reel 18 is preferably constructed of plastic but can be constructed of stainless steel, or any other suitable material. It preferably has a diameter of about 33, inches. Cylinder 13 of tank 12 extends vertically upwardly from floor 12*c*, of tank 12 and terminates at circular bearing 46. Lower cylindrical portion 18*c*, of hose reel 18 extends vertically downwardly through bearing 46 and cylinder 13 of tank 12 so that base portion 18*b*, of hose reel 18 is mounted for rotation about a vertical axis on bearing 46.

As illustrated in FIGS. 1 and 2, hose 11 is connected at its first end 11*a*, to suction cleaner fitting 52*a*, or pressure cleaner fitting 62*a*. Second end 11*b*, of hose 11 is connected to a conventional cleaner head 200. During storage, hose 11 is located in a first storage position, wound around outer surface 19*b*, of drum portion 18*a*, of hose reel 18 and resting on base portion 18*b*, of hose reel 18. In this position, second end 11*b*, of hose 11 and the cleaner head 200 rest in passageway 14.

Figure 7:
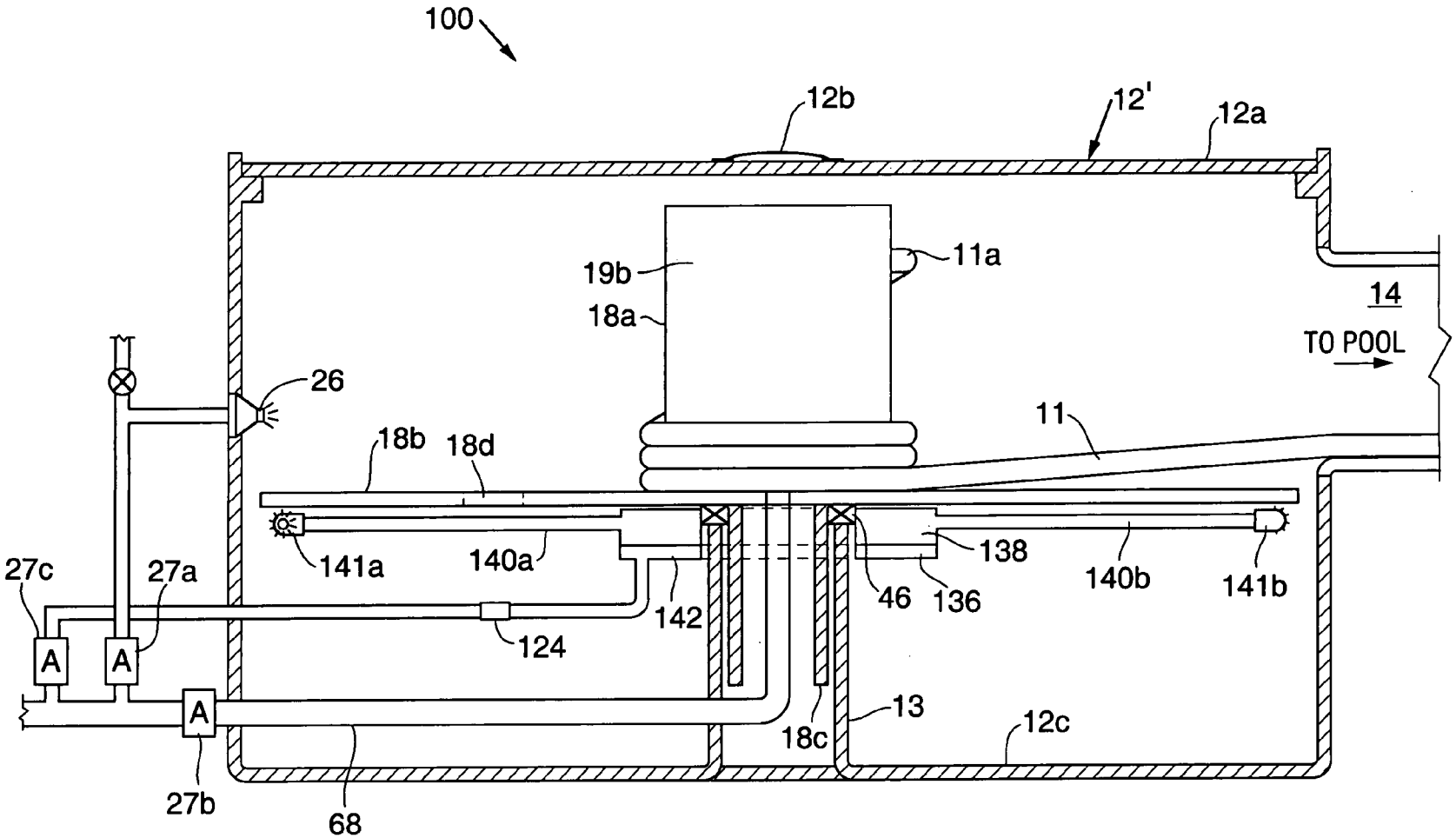
FIG. 7 is a cross-sectional elevational view of the second embodiment of the invention showing a hose wrapped around the hose reel.

When suction cleaner 50 or pressure cleaner 60 is in use, hose 11 is relocated to a second position in pool 16 (illustrated in FIG. 3 and in FIG. 7, with reference to the second embodiment), as follows. Pipe 22 is connected to a pressurized water source (not shown) at one end and a blow out jet nozzle 26 at the other end. Pipe 22 preferably has a diameter of about ¾ inch. Blow out jet nozzle 26 is comparable to a fire hose nozzle. To unwind hose 11 from hose reel 18 and move hose 11 from the first storage position to a second position in pool 16, the pressurized water source is turned on via solenoid valve 27*a*, and water travels through pipe 22 and out blow out jet nozzle 26. The water is directed toward the cleaner head (not shown) of hose 11, and flushes cleaner head and hose 11 out of tank 12, through passageway 14 and into pool 16. This causes hose reel 18 to rotate in a first direction, and unwinds hose 11 from hose reel 18. This allows hose 11 to be moved from the first storage position (wound around hose reel 18) to a second position wherein hose 11 is unwound from hose reel 18 and travels through passageway 14 to pool P, and second end 11*b*, of hose 11 and the cleaner head (not shown) are located in pool P.

According to the first embodiment of the invention, hose 11 is returned to the first storage position from the second position as follows. Circular water wheel 36 includes a plurality of vertically extending blades 37 disposed about its circumference between its upper surface 36*a*, and its lower surface 36*b*. The water wheel 36 is configured to receive: (1) pipe 58 of suction cleaner 50 or pipe 68 of pressure cleaner 60, respectively, (2) cylinder 13 of tank 12 and (3) lower cylindrical portion 18*c*, of hose reel 18. Hose reel 18 and water wheel 36 are preferably formed as a single unit by injection molding. Alternatively, if hose reel 18 and water wheel 36 are formed separately, upper surface 36*a*, of water wheel 36 is connected to base portion 18*b*, of hose reel 18 through any suitable connecting means, such as screws or other fasteners. Circular water wheel 36 is preferably constructed of plastic or any other suitable material.

Jet nozzle 41 is connected to pipe 48 which is connected to a pressurized water source (not shown). To rotate water wheel 36 and hose reel 18 in a second direction and rewind hose 11 onto hose reel 18, suction cleaner 50 (or pressure cleaner 60) is turned off via a conventional solenoid valve 27*b*; Then water is provided from the pressurized water source via conventional solenoid valve 27*c*, through pipe 48 and jet nozzle 41 and directed horizontally at blades 37 of water wheel 36, causing rotation of water wheel 36 and hose reel 18 in a second direction. The general direction of water from jet nozzle 41 toward blades 37 of water wheel 36 is indicated by arrow 41*a*, in FIG. 3. Such rotation withdraws hose 11 from pool P and rewinds hose 11 around outer surface 18*b*, of hose reel 18 to return hose 11 to the first storage position wound around hose reel 18. Solenoid valves 27*a*, 27*b* and 27*c*, may be any conventional valve, such as valves sold by Waterpik Technologies—Jandy Products. The lower portion of tank 12 is in communication with pool 16 via passageway 21 so that water from pipe 48 flows into pool 16.

With reference to FIGS. 4-7, according to the second embodiment of the invention, device 100 includes tank 12' with removable cover plate 12*a*, and a handle 12*b*; hose reel 18; and a hollow donut-shaped swivel 136 having a central hole formed therethrough and an inner chamber formed therein. Tank 12' does not include passageway 21 of tank 12.

Figure 4:
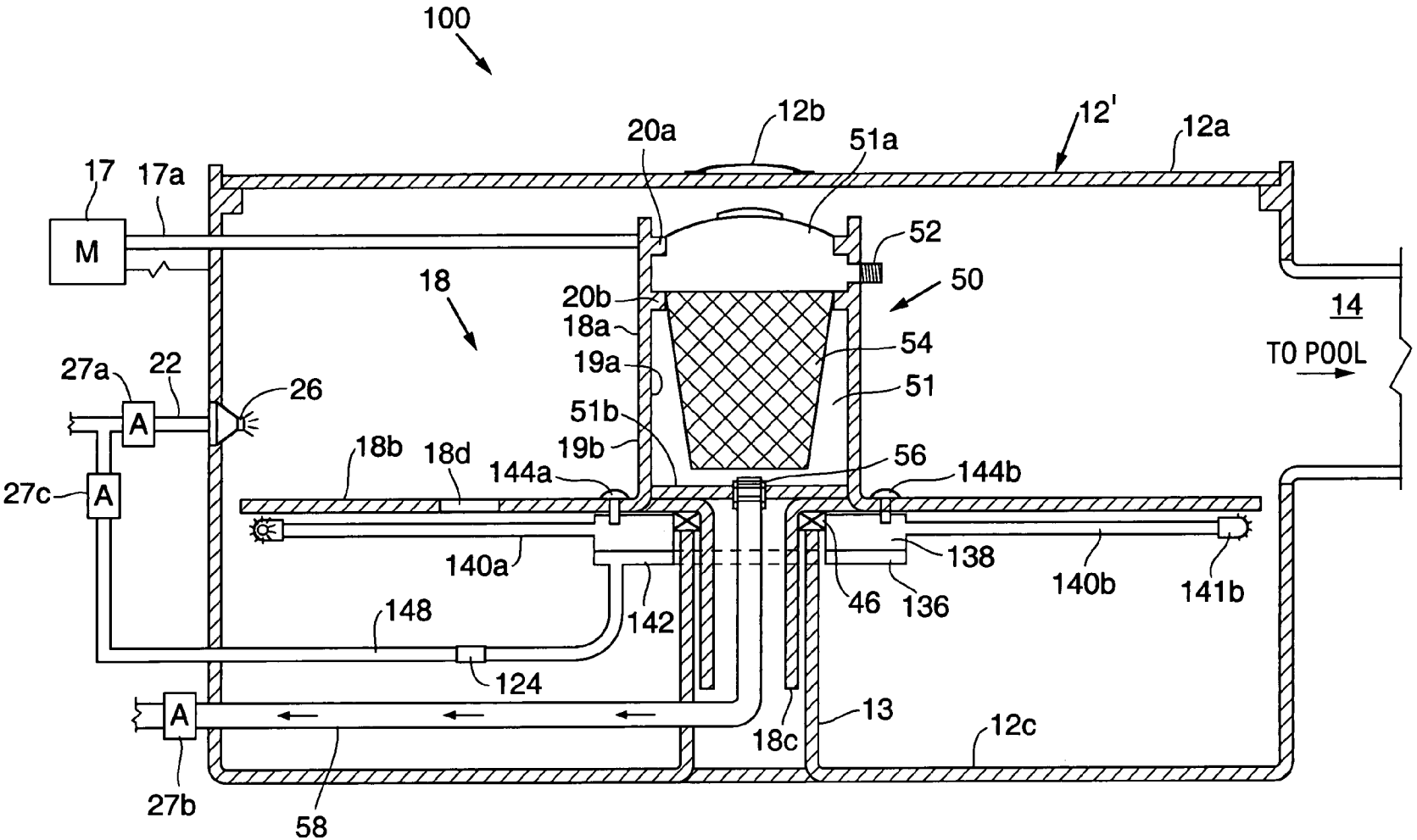
FIG. 4 is a cross-sectional elevational view of a second embodiment of the invention used in connection with a suction pool cleaner, showing the hose reel in cross-section, with the hose removed.
Figure 5:
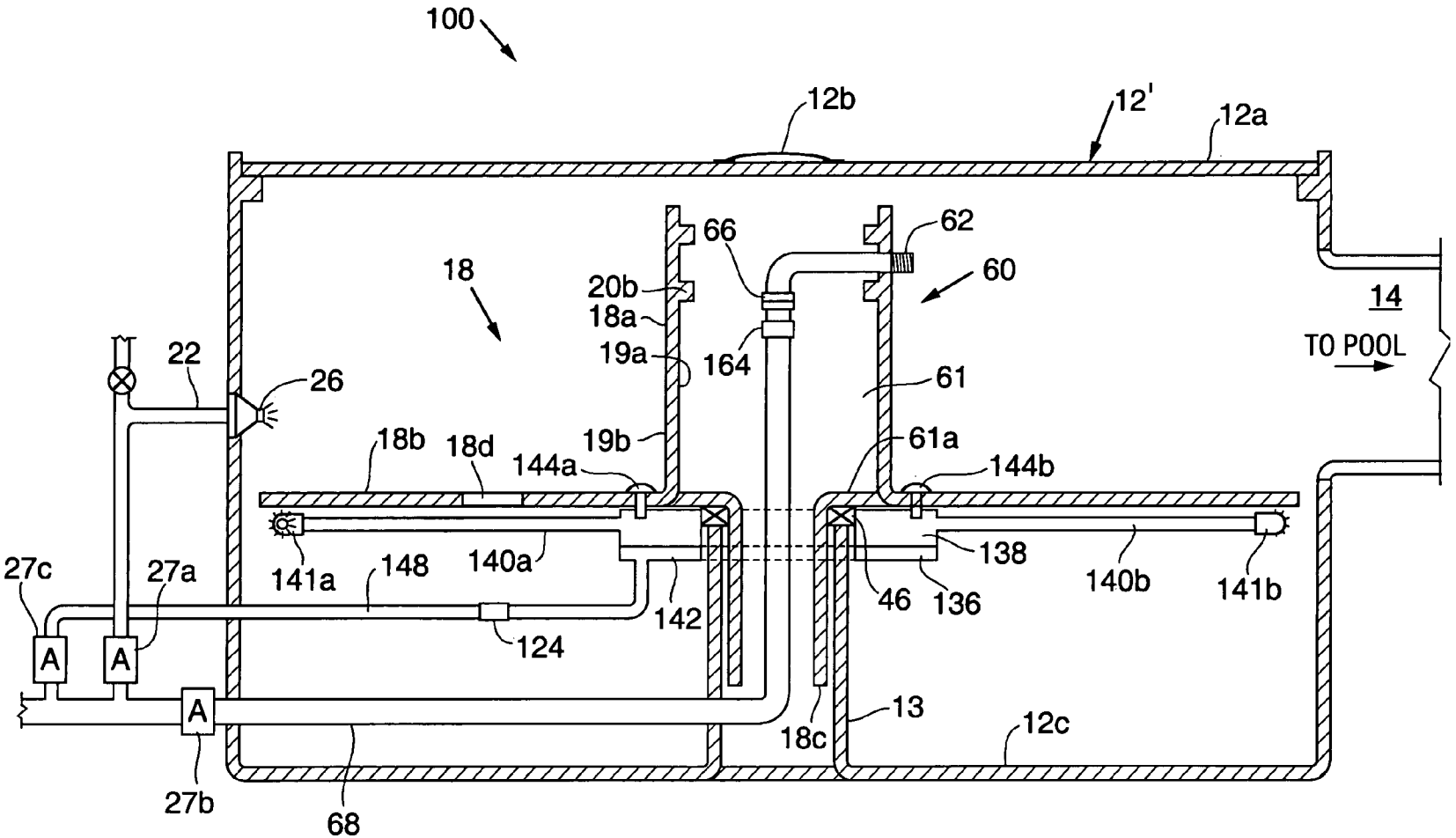
FIG. 5 is a cross-sectional elevational view of the second embodiment of the invention used in connection with a pressure pool cleaner, showing the hose reel in cross-section, with the hose removed.
Figure 6:
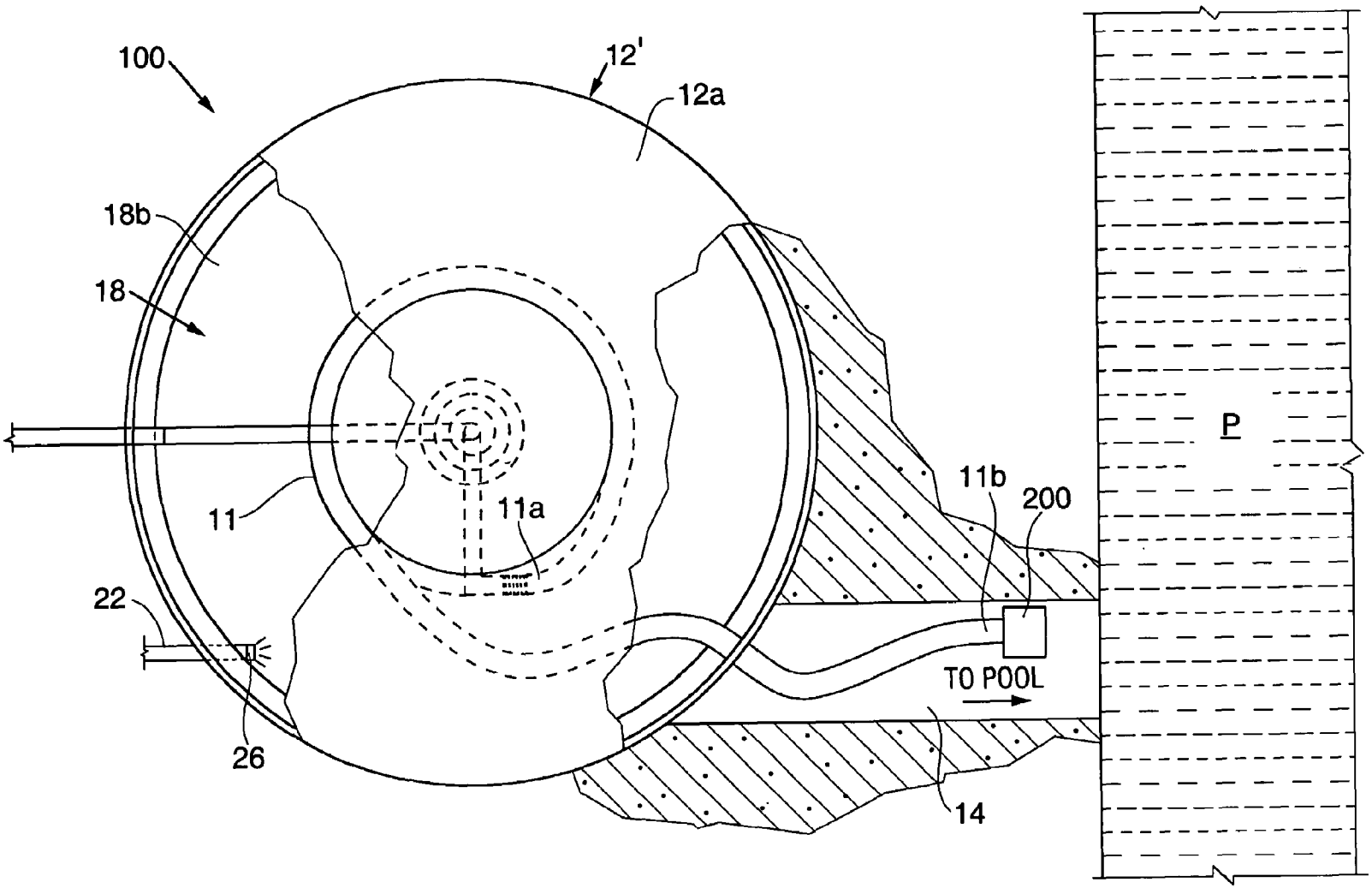
FIG. 6 is a top plan view of the second embodiment of the invention.

As illustrated in FIG. 4, a suction source (not shown) is connected to pipe 58. The pipe extends vertically upwardly through cylinder 13 of tank 12', cylindrical portion 18*c*, of hose reel 18, the central hole in donut-shaped swivel 136, floor 51*b*, of chamber 51 and into chamber 51 via swivel 56. Similarly, as illustrated in FIG. 5, the pipe 68 of pressure pool cleaner 60 is connected to a pressurized water source (not shown) and extends vertically upwardly through cylinder 13 of tank 12', cylindrical portion 18*c*, of hose reel 18 and the central hole in donut-shaped swivel 136, and into chamber 61, terminating at swivel 66.

According to the second embodiment of the invention, hose 11 is returned to the first storage position from the second position as follows. Hollow, donut-shaped swivel 136 includes (1) a rotatable upper portion 138 having a first and second hollow rotation jet arms 140*a*, 140*b*, extending horizontally outwardly therefrom and (2) a fixed lower portion 142. Rotatable upper portion 138 and fixed lower portion 142 are connected to each other, for example, by four or more clamps (not shown) attached to lower portion 142 that carry rollers which ride on a ledge (not shown) provided around the circumference of the upper portion 138. The central hole (not shown) formed in donut-shaped swivel 136 is configured to receive (1) pipe 58 of suction cleaner 50 or pipe 68 of pressure cleaner 60, respectively, (2) cylinder 13 of tank 12 and (3) cylindrical portion 18*c*, of hose reel 18. Rotatable upper portion 138 of donut-shaped swivel 136 is connected to rotatable hose reel 18 via fasteners 144*a*, 144*b*, such as screws or any other suitable means. Donut-shaped swivel 136 is preferably constructed of plastic or any other suitable material.

Lower fixed portion 142 of donut-shaped swivel 136 is connected to pipe 148 which is connected to a pressurized water source (not shown). To rotate upper portion 138 of donut-shaped swivel 136 and hose reel 18 in a second direction and rewind hose 11 onto hose reel 18, suction cleaner 50 (or pressure cleaner 60) is turned off via solenoid valve 27*b*. Then water is provided from the pressurized water source via solenoid valve 27*c*, through pipe 148 into the inner chamber (not shown) of donut-shaped swivel 136. The water travels through hollow first and second rotation jet arms 140*a*, 140*b*, and out first and second water jets 141*a*, 141*b*, causing rotation of upper portion 138 of donut-shaped swivel 136 and hose reel 18 in a second direction. Such rotation withdraws hose 11 from pool 14 and rewinds hose 11 around outer surface 18*b*, of hose reel 18 to return hose 11 to the first storage position wound around hose reel 18.

Although the preferred method for rotating hose reel 18 in first direction to unwind hose 11 or a second direction to rewind hose 11, in both the first and second embodiments of the invention, is water jet propulsion as described above, other means of rotation can be used either in addition to or instead of water jet propulsion. For example, a conventional electric motor 17 (illustrated in FIG. 1) can be attached to hose reel 18. The motor 17 may include a drive belt 17*a*, attached to hose reel 18. The motor 17 can be located in a well adjoining tank 12 with the drive belt operating in a horizontal plane just above the water level in tank 12.

According to a second example, one or more unwind jets 280 (see FIG. 1) can be attached to pipe 22 and operated via a conventional solenoid valve to rotate the hose reel in the first direction to aid the blow out jet in unwinding hose reel 18 and flushing the hose through the tunnel to the pool.

Device 10 is easily removed from tank 12 for maintenance as follows. Cover plate 12*a*, of tank 12 or tank 12' is removed. According to the first embodiment, hose reel 18 can be simply lifted up and out of tank 12. According to the second embodiment, pipe 148 is disconnected at fastener 124 by utilizing access hole 18*d*, (and, for pressure cleaner 60, pipe 68 is disconnected from hose connection pipe 62 at fastener 164), and hose reel 18 is simply lifted up and out of tank 12'. Access hole 18*d*, is preferably about 6, to 8, inches in diameter.

The Over-The-Deck Embodiment

The over-the-deck embodiment is shown in FIGS. 8-12. Although this embodiment is depicted with a pressure type cleaner having a cleaner head 70, it should be understood that it is also adapted for use with a suction pool cleaner of the type shown in FIGS. 1 and 4. The internal details of the over-the-deck embodiment correspond to those of those of the under-the-deck embodiments. The differences between the under-the-deck and over-the-deck embodiments reside, primarily, in the construction of the tunnel which leads from the reel tank to the edge of the pool. Accordingly, parts of the tank and reel shown in the over-the-deck embodiment are designated by numerals corresponding to those used for the under-the-deck embodiments, as follows: hose reel automatic storage device 10; hose 11; tank 12; removable lid 12*a*; rotatable hose reel 18; circular base 18*b*; water wheel 36 having vertically extending blades 37; jet nozzle 41 for directing a jet of water against the water wheel 36 to rewind the hose and pool cleaner head 200.

Figure 11:
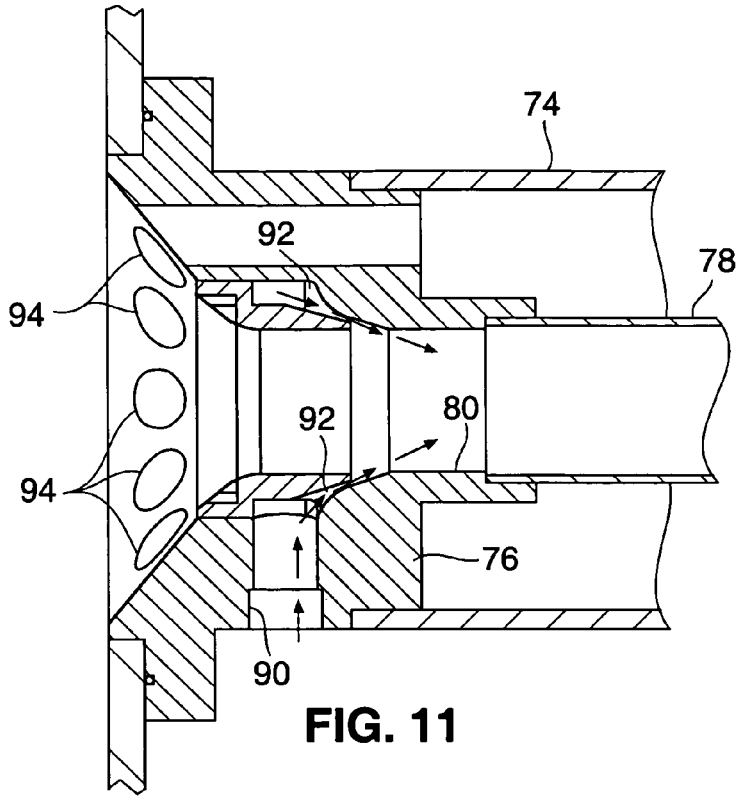
FIG. 11 is a cross-sectional view, with parts thereof broken away, showing the annular jet nozzle used to propel the hose into the pool, with the embodiment of FIG. 9.

The tunnel of the over-the-deck embodiment, designated in its entirety by the letter T, comprises: an outer tube 72 having a proximal end secured in fluid communication with the interior of the tank 12 by an enlarged transition piece 74 and intervening jet nozzle body 76; and an inner tube 78 secured to the jet nozzle body 76 in alignment with a passage 80 extending through the nozzle body (see FIG. 11). Typical, internal diameters for the conduits making up the tunnel are: four inches for the outer tube 72; two inches for the inner tube 78; and six inches for the larger diameter of the transition piece 74. The length of the tunnel T will be determined by the dimensions of the pre-existing pool and surrounding deck. In the example shown, the inner tube 78 has a length approximately one-half of the outer tube 72, in order that the distal portion of the outer tube may provide an enlarged diameter into which relatively large structures carried by the hose 11 (e.g. timer devices) may be drawn. As shown, floats F are secured to the hose 11 at spaced intervals. These floats have an external diameter slightly that less than that of the inner tube 78 in order that they may pass through the tube and in function in bullet-like fashion in response to water jetted into the tube, to flush the hose 11 through the tubes 72 and 78 and into the pool, designated P.

The distal ends of the tubes 72 and 78 are flared, as seen at 82 and 84, respectively. These flared ends facilitate the passage of the hose and the elements carried thereby through the tubes. Also, they minimize abrasion of the hose, as it passes through the tubes.

Figure 9:
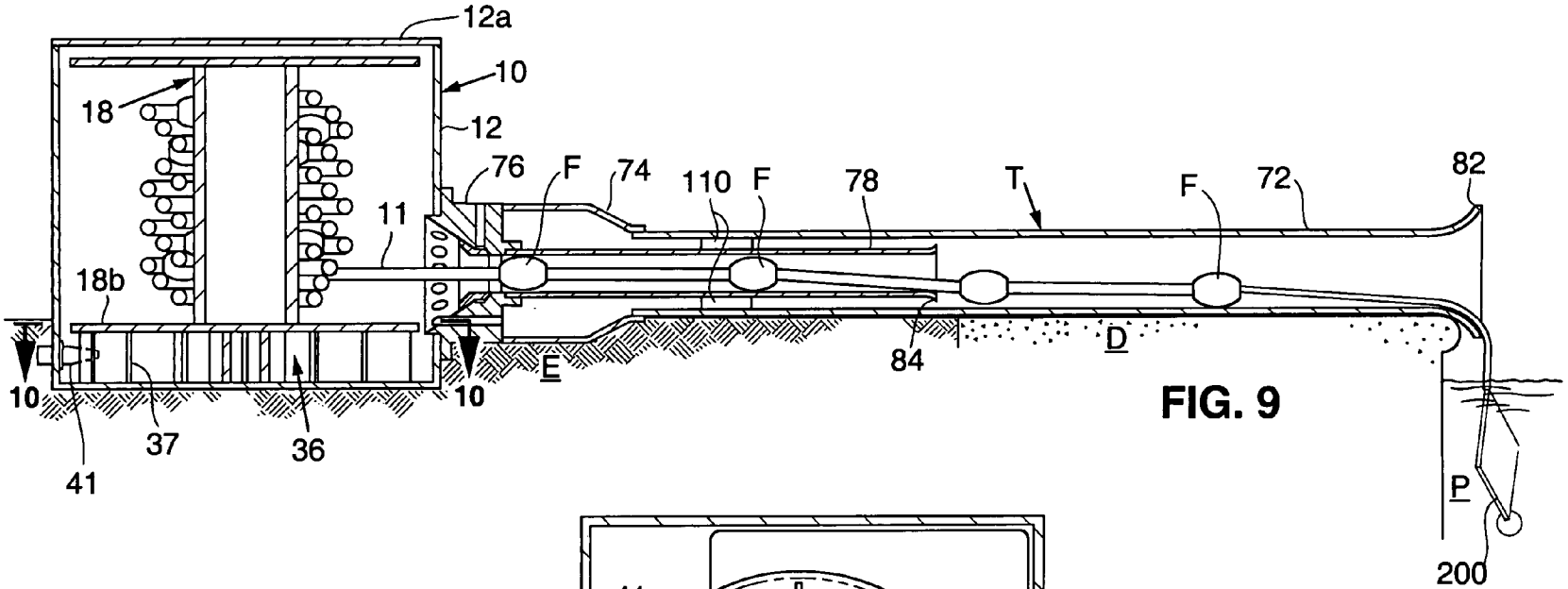
FIG. 9 is a cross-sectional elevational view of the over-the-deck embodiment of the invention, illustrated in association with the pool, with the pool cleaner disposed in a storage condition at one side of the pool.

As depicted in FIG. 9, the tank 12 is spaced from the pool P and supported on a portion of the earthen formation E disposed to the outside of the pool deck D. The earthen formation is partially excavated in order that the outer tube 72 may rest directly on and be flush with the deck D. The flared end 82 of the tube 72 extends over the edge 86 of the pool, to facilitate the passage of the hose 11 into and out of the pool and the discharge of water from the tube 72 and into the pool.

Figure 10:
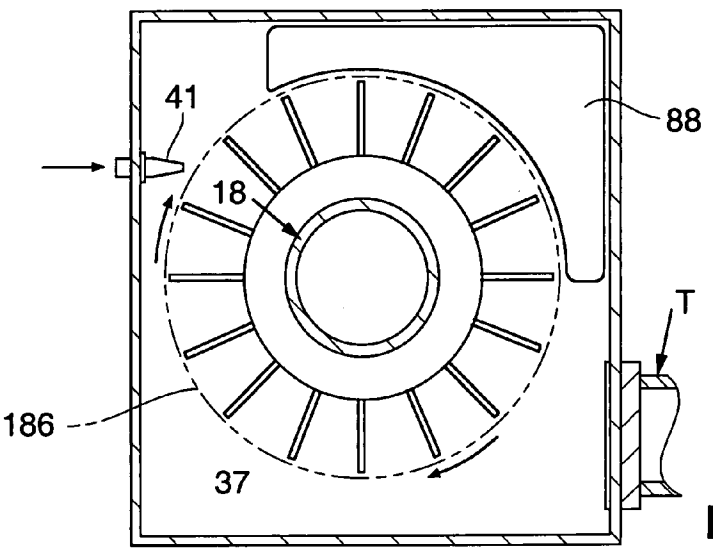
FIG. 10 is a cross-sectional view taking on the plane designated by line 10-10 of FIG. 9.

While the tank 12 shown in FIG. 10 is of a rectangular configuration, it should be understood that the tank might equally be cylindrical, as in the under-the-deck embodiments. Also, while a water guide 88 is shown in the tank 12 to confine water around the water wheel 36, such guide may be omitted.

The jet nozzle body 76 provides for both the jetting of water into the inner tube 78, and for the drainage of water out of the tank 12. The jetting water is depicted by the dashed arrow lines shown in FIG. 11, wherein it can be seen that high pressure water enters the nozzle body through the passage 90 and discharges therefrom through an angular jet nozzle 92. Water discharges from the nozzle toward the hose and the floats carried thereby, and functions to propel the floats F through the tube 78 in bullet like fashion. A plurality of drainage passages 94 extend through the jet nozzle body 76 to establish fluid communication between the interior of the tank 12 and the transition piece 74. These passages permit water to drain from the tank for discharge into the pool, and prevent the accumulation of water within the tank 12. The outer tube 72 provides the conduit for such discharge. The tubes 78 and 72 are in spaced generally concentric relationship to provide an annular space therebetween for the passage of water.

Figure 12:
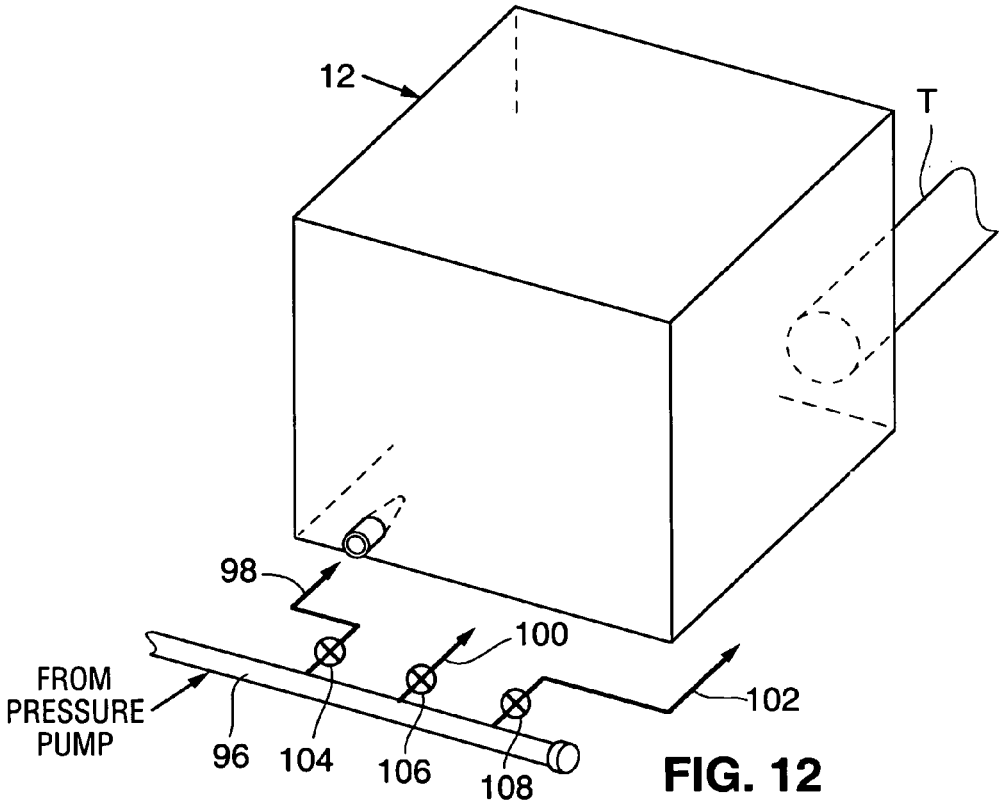
FIG. 12 is a diagrammatic view, illustrating the plumbing for the FIG. 9 embodiment.

The plumbing diagrammatically shown in FIG. 12 comprises a manifold pipe 96 connected to the pressure pump for the pool filtration system, and solenoid valve controlled pipes 98, 100 and 102 connected to the pipe 96. The solenoid valves for respective pipes are designated by the numerals 104, 106 and 108. Valve 104 controls the flow of water to the nozzle 41. Valve 108 controls the flow of water to the inlet passage of the annular jet nozzle 92. Valve 106 controls the flow of water to the hose 11.

Figure 8:
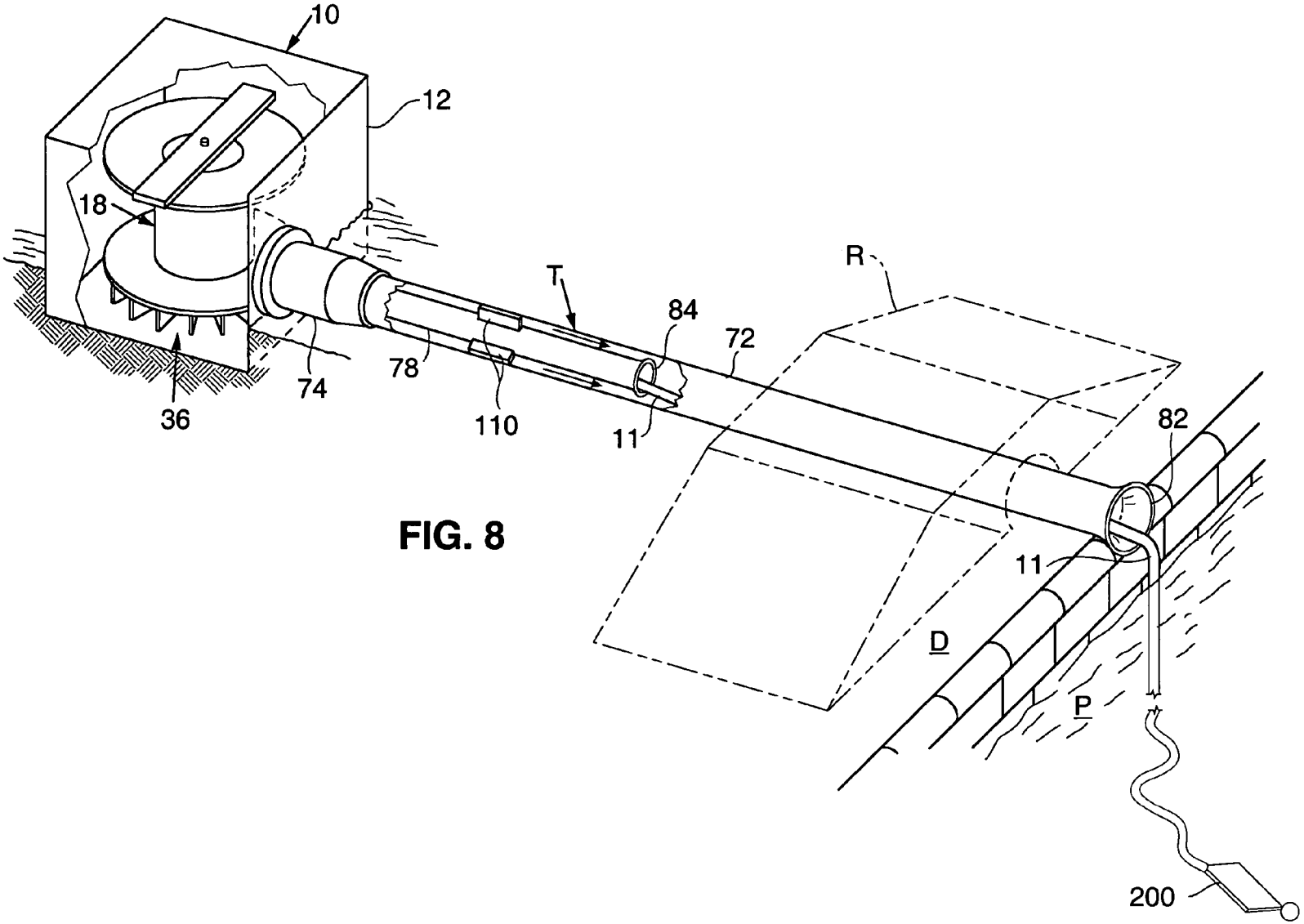
FIG. 8 is a perspective view of the over-the-deck embodiment of the present invention with the associated pool cleaner disposed within the pool.

Wing-like spacers 110 are provided at annularly spaced locations around the inner tube 78 to assist in maintaining this tube in alignment with the outer tube 72. These may be seen from FIGS. 8 and 9. FIG. 8 also depicts a ramp R supported on the deck D and extending over the tunnel T. This ramp is for esthetic and safety purposes and also functions to assist in holding the tunnel against inadvertent displacement.

Modifications and variations of the above-described embodiments of the present invention are possible, as appreciated by those skilled in the art in light of the above teachings. It is therefore to be understood that, within the scope of the appended claims and their equivalents, the invention may be practiced otherwise than as specifically described.

I claim:

1. A device for moving the hose of an automatic pool cleaner over a pool deck and into a swimming pool, comprising:

a rotatable hose reel disposed within a tank adapted to be located in spaced relationship to the swimming pool, the hose being wound around the hose reel and extending therefrom through a tunnel adapted to be disposed over the pool deck, said tunnel having a first end in communication with the tank and a second end adapted to be disposed for discharge over an edge of the pool; and first jet means disposed in stationary relationship to the tank, said first jet means being directed into the tunnel for propelling water through the tunnel to rotate the hose reel in a first direction and unwind and flush the hose through the tunnel.

2. The device of claim 1, wherein the first jet means comprises an annular water jet disposed within the tunnel for discharge toward the second end thereof.

3. The device of claim 2 wherein:

the hose carries spaced annular floats disposed therearound and proportioned for passage through the tunnel; and, the water discharged from the first jet means impinges on the floats.

4. The device of claim 1 further comprising a drain conduit extending from the tank and adapted to be extended over the deck to the edge of the pool, for discharge into the pool.

5. The device of claim 4 wherein;

the tunnel comprises generally concentric inner and outer conduits disposed in spaced relationship to one another; and the outer conduit provides the drain conduit.

6. The device of claim 1 wherein;

the tunnel comprises inner and outer conduits disposed in generally concentric relationship to one another, said inner conduit having a reduced cross-section relative to that of the outer conduit and said outer conduit has a distal end; and, the inner conduit terminates short of the distal end of the outer conduit whereby the outer conduit provides a tunnel section into which items larger than the cross-section of the inner conduit may be drawn.

7. The device of claim 1, further comprising rotation means for rotating the hose reel in a second direction to withdraw the hose from the pool through the tunnel and rewind the hose around the hose reel.

8. The device of claim 7, wherein the rotation means comprises:

a circular, rotatable water wheel attached to the hose reel, the water wheel having a plurality of annularly spaced blades disposed therearound; and jet means for directing water toward the blades of the water wheel to rotate the hose reel in the second direction and withdraw the hose into the tunnel.

9. A device for moving the hose of an automatic pool cleaner over a pool deck and into and out of a swimming pool, comprising:

a rotatable hose reel disposed within a tank adapted to be located in spaced relationship to the swimming pool, the hose being wound around the hose reel during storage and extending partially therefrom through a tunnel adapted to be disposed over the pool deck, said tunnel having a first end in communication with the tank and a second end adapted to be disposed for discharge over an edge of the pool, the hose having a cleaner head at an end thereof extending form the second end of the tunnel for movement with the hose between a storage condition hanging from the second end of the tunnel and an extended operating condition;

a water jet disposed in stationary relationship to the tank for directing a stream of water into the tunnel to rotate the hose reel in a first direction, unwind the hose from the hose reel, flush the hose through the tunnel, and dispose the cleaner head in the extended operating condition; and, rotation means for rotating the hose reel in a second direction to withdraw the hose through the tunnel, and rewind the hose around the hose reel to a position wherein the cleaner head is disposed in the storage condition.

10. The device of claim 9, wherein the rotation means comprises:

a circular, rotatable water wheel attached to the hose reel, the water wheel having a plurality of annularly spaced blades disposed therearound its circumference; and jet means for directing water toward the blades of the water wheel to rotate the hose reel in the second direction.

11. A method for moving the hose of an automatic pool cleaner over a pool deck and into and out of a swimming pool, comprising:

providing a rotatable hose reel in a tank adapted to be located in spaced relationship to the pool;

providing a tunnel adapted to be disposed over the pool deck, said tunnel having a first end in communication with the tank and a second end adapted to be disposed to discharge over an edge of the pool;

winding the hose around the hose reel to store the hose in the tank, with a portion of the hose extending partially through the tunnel, the hose having a cleaner head at one end disposed for movement with the hose between storage and operating positions; and jetting a stream of water into the first end of the tunnel, from a water jet disposed in stationary relationship to the tank, to rotate the hose reel in a first direction and flush the hose through the second end of the tunnel for extension, with the cleaner head.

12. The method of claim 11, further comprising the step of rotating the hose reel in a second direction to withdraw the hose through the tunnel and rewind the hose around the hose reel.

* * * * *